US010971314B2

(12) United States Patent
Chiang et al.

(10) Patent No.: US 10,971,314 B2
(45) Date of Patent: Apr. 6, 2021

(54) KEY SWITCH

(71) Applicant: DARFON ELECTRONICS CORP., Taoyuan (TW)

(72) Inventors: Chih-Hsiang Chiang, Taoyuan (TW); Cheng-Min Su, Taoyuan (TW); Chin-Lung Chan, Taoyuan (TW); Yu-Chih Chang, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/880,920

(22) Filed: May 21, 2020

(65) Prior Publication Data

US 2021/0012982 A1 Jan. 14, 2021

(30) Foreign Application Priority Data

Jul. 10, 2019 (TW) ..... 108124188

(51) Int. Cl.

| | |
|---|---|
| ***H01H 13/12*** | (2006.01) |
| ***H01H 13/14*** | (2006.01) |
| ***H01H 13/50*** | (2006.01) |
| ***H01H 13/20*** | (2006.01) |
| ***H01H 13/10*** | (2006.01) |

(52) U.S. Cl.

CPC ..... *H01H 13/14* (2013.01); *H01H 13/10* (2013.01); *H01H 13/20* (2013.01); *H01H 13/50* (2013.01); *H01H 2233/07* (2013.01)

(58) Field of Classification Search

CPC ..... H01H 3/125; H01H 13/83; H01H 13/705; H01H 2215/006; H01H 13/14; H01H 13/704; H01H 2221/058; H01H 13/70; H01H 13/7065; H01H 3/12; H01H 15/16; H01H 2237/00; H01H 13/20; H01H 13/50

See application file for complete search history.

(56) References Cited

U.S. PATENT DOCUMENTS 8,779,308 B2 * 7/2014 Takemae ..... H01H 13/702 200/5 A
10,714,282 B2 * 7/2020 Izawa ..... H01H 11/00
2003/0188960 A1 10/2003 Hsu (Continued)

FOREIGN PATENT DOCUMENTS

CN 105895433 A 8/2016
TW 201703085 A 1/2017

*Primary Examiner* — Ahmed M Saeed
(74) *Attorney, Agent, or Firm* — Winston Hsu

(57) ABSTRACT

A key switch includes a base, a key cap, a first support member and a second support member. The key cap is disposed with respect to the base. The first support member and the second support member are disposed between the key cap and the base. The first support member has a first linkage structure. The second support member has a second linkage structure. The first linkage structure and the second linkage structure abut against each other, such that the first support member and the second support member rotate synchronously with respect to a horizontal axis. When one of the first support member and the second support member horizontally moves with respect to the other one of the first support member and the second support member within a predetermined range along the horizontal axis, the first linkage structure and the second linkage structure keep abutting against each other.

1 Claim, 14 Drawing Sheets

(56) References Cited

U.S. PATENT DOCUMENTS

| | | | | |
|---|---|---|---|---|
| 2014/0116865 | A1* | 5/2014 | Leong | G06F 3/0202 200/344 |
| 2014/0174900 | A1* | 6/2014 | Hsu | H01H 3/122 200/344 |
| 2015/0332875 | A1* | 11/2015 | Hsu | H01H 3/125 200/344 |
| 2016/0064165 | A1* | 3/2016 | Chao | H01H 13/14 200/344 |

* cited by examiner

KEY SWITCH

BACKGROUND OF THE INVENTION

1. Field of the Invention

The invention relates to a key switch and, more particularly, to a key switch capable of adjusting a size by moving a support member horizontally.

2. Description of the Prior Art

A keyboard, which is the most common input device, can be found in variety of electronic equipment for users to input characters, symbols, numerals and so on. The keyboard consists of a plurality of key switches for users to input characters, symbols, numerals and so on. The key switch usually comprises a base, a key cap and a support device disposed between the key cap and the base, such that the key cap can move with the support device between a non-pressed position and a pressed position with respect to the base. In general, there are lots of key switches with different sizes disposed on the keyboard. Therefore, when the keyboard is manufactured, different support devices have to be designed for the key switches with different sizes, such that the mold type of the support device becomes complicated and the number of molds increases. Consequently, the manufacturing cost increases.

SUMMARY OF THE INVENTION

An objective of the invention is to provide a key switch capable of adjusting a size by moving a support member horizontally, so as to solve the aforesaid problems.

According to an embodiment of the invention, a key switch comprises a base, a key cap, a first support member and a second support member. The key cap is disposed with respect to the base. The first support member is disposed between the key cap and the base. The first support member has a first linkage structure. The second support member is disposed between the key cap and the base and with respect to the first support member. The second support member has a second linkage structure. The first linkage structure and the second linkage structure abut against each other, such that the first support member and the second support member rotate synchronously with respect to a horizontal axis. When one of the first support member and the second support member horizontally moves with respect to the other one of the first support member and the second support member within a predetermined range along the horizontal axis, the first linkage structure and the second linkage structure keep abutting against each other.

As mentioned in the above, two support members of the invention can horizontally move with respect to each other within the predetermined range along the horizontal axis, so as to be applied to different key switches with different sizes. Therefore, when a keyboard is manufactured, the invention may classify the key switches with different sizes first and then design the support member for each type of key switch. Accordingly, the invention can simplify the mold type and reduce the number of molds, so as to reduce the manufacturing cost.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
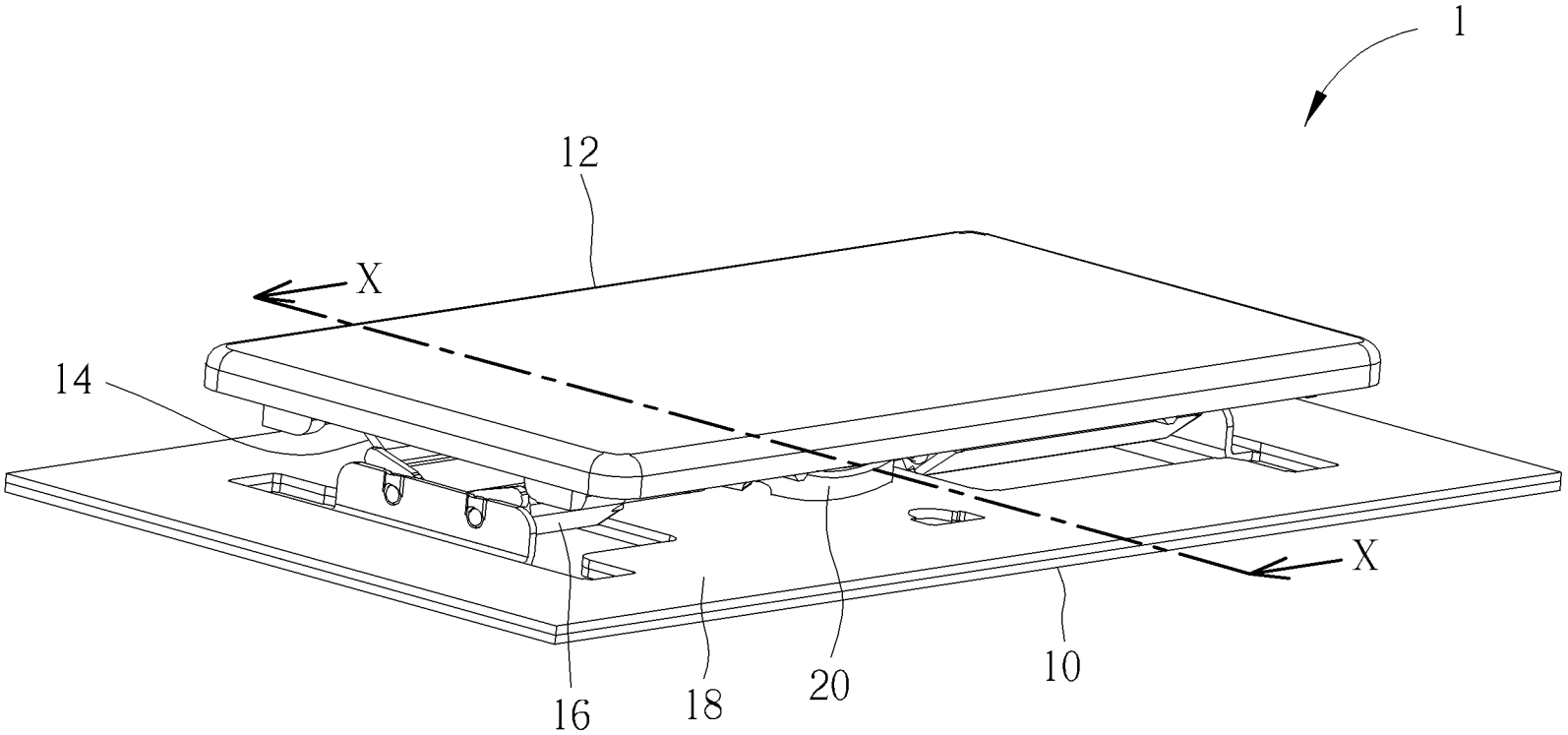
FIG. 1 is a perspective view illustrating a key switch according to an embodiment of the invention.
Figure 2:
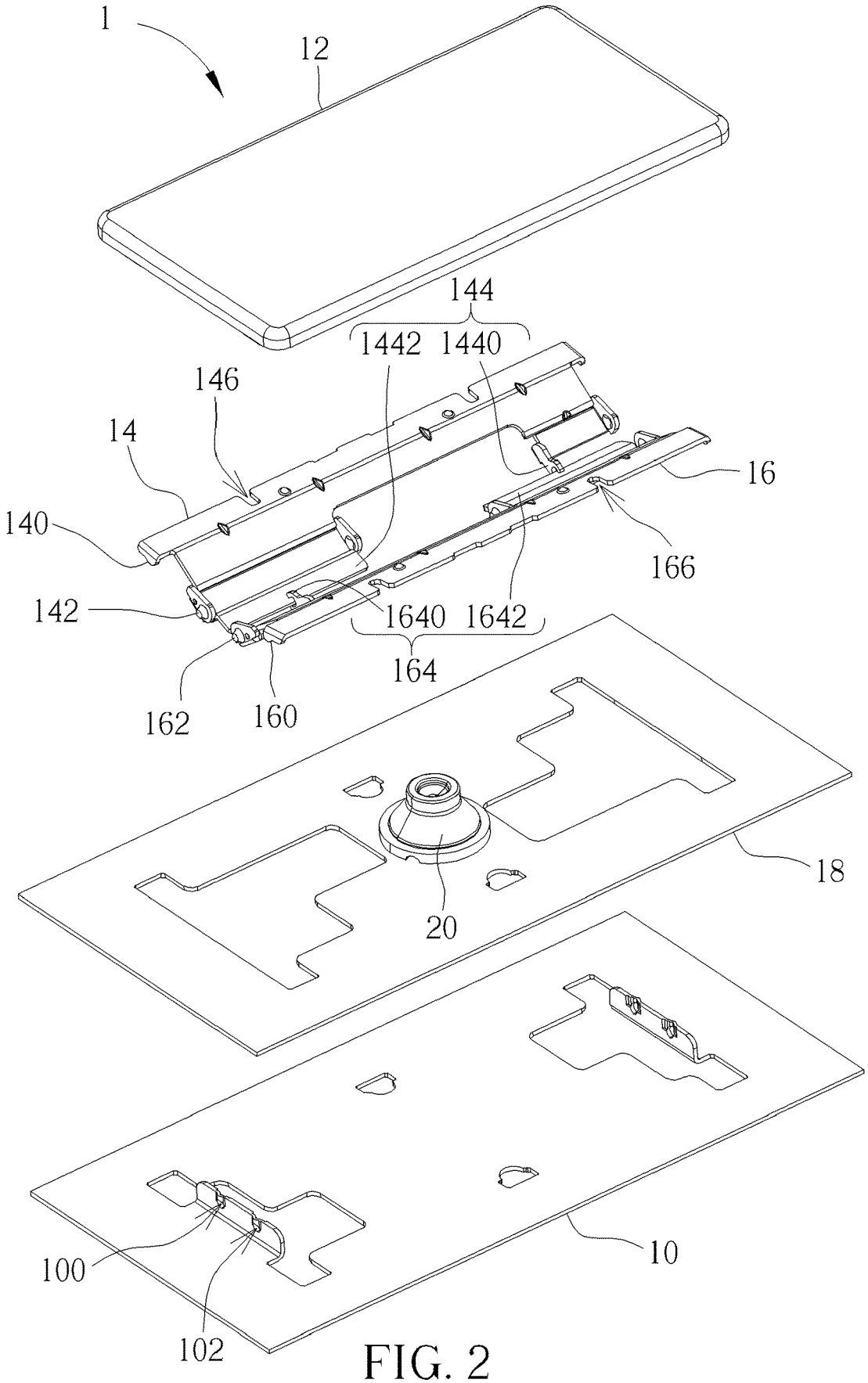
FIG. 2 is an exploded view illustrating the key switch shown in FIG. 1.
Figure 3:
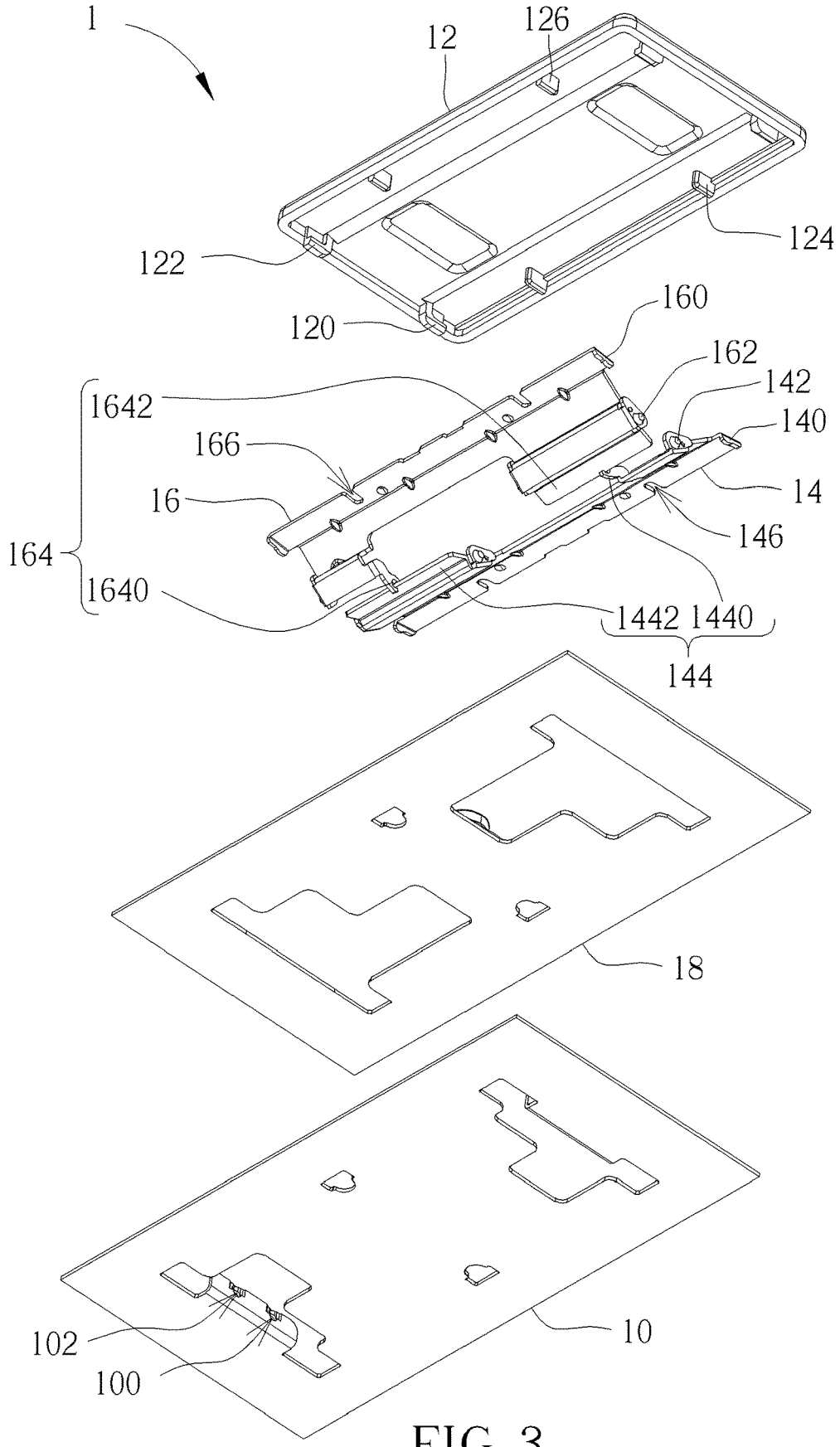
FIG. 3 is an exploded view illustrating the key switch shown in FIG. 1 from another viewing angle.
Figure 4:
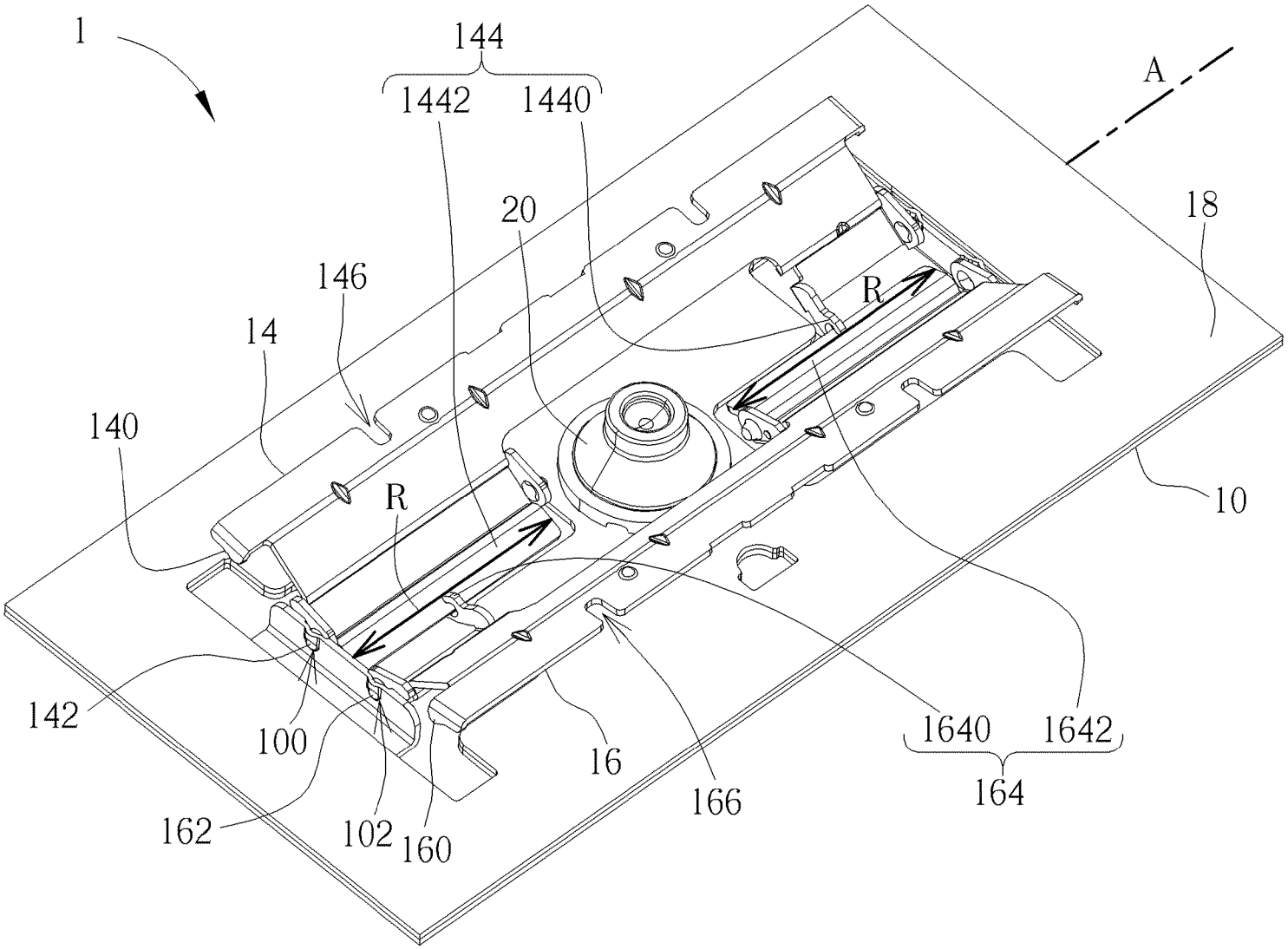
FIG. 4 is an assembly view illustrating the base, the first support member, the second support member, the circuit board and the resilient member shown in FIG. 2.
Figure 5:
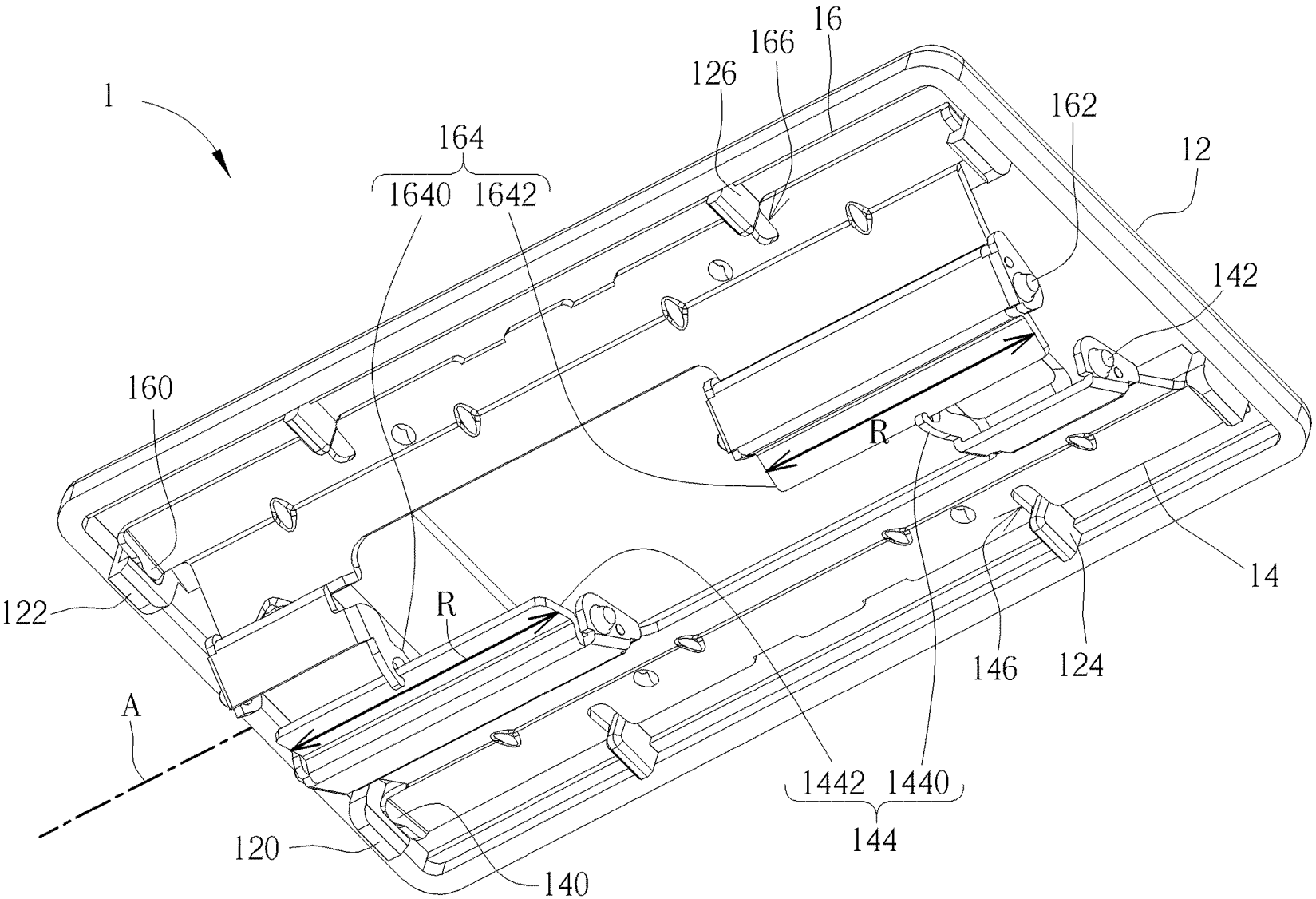
FIG. 5 is an assembly view illustrating the key cap, the first support member and the second support member shown in FIG. 3.
Figure 6:
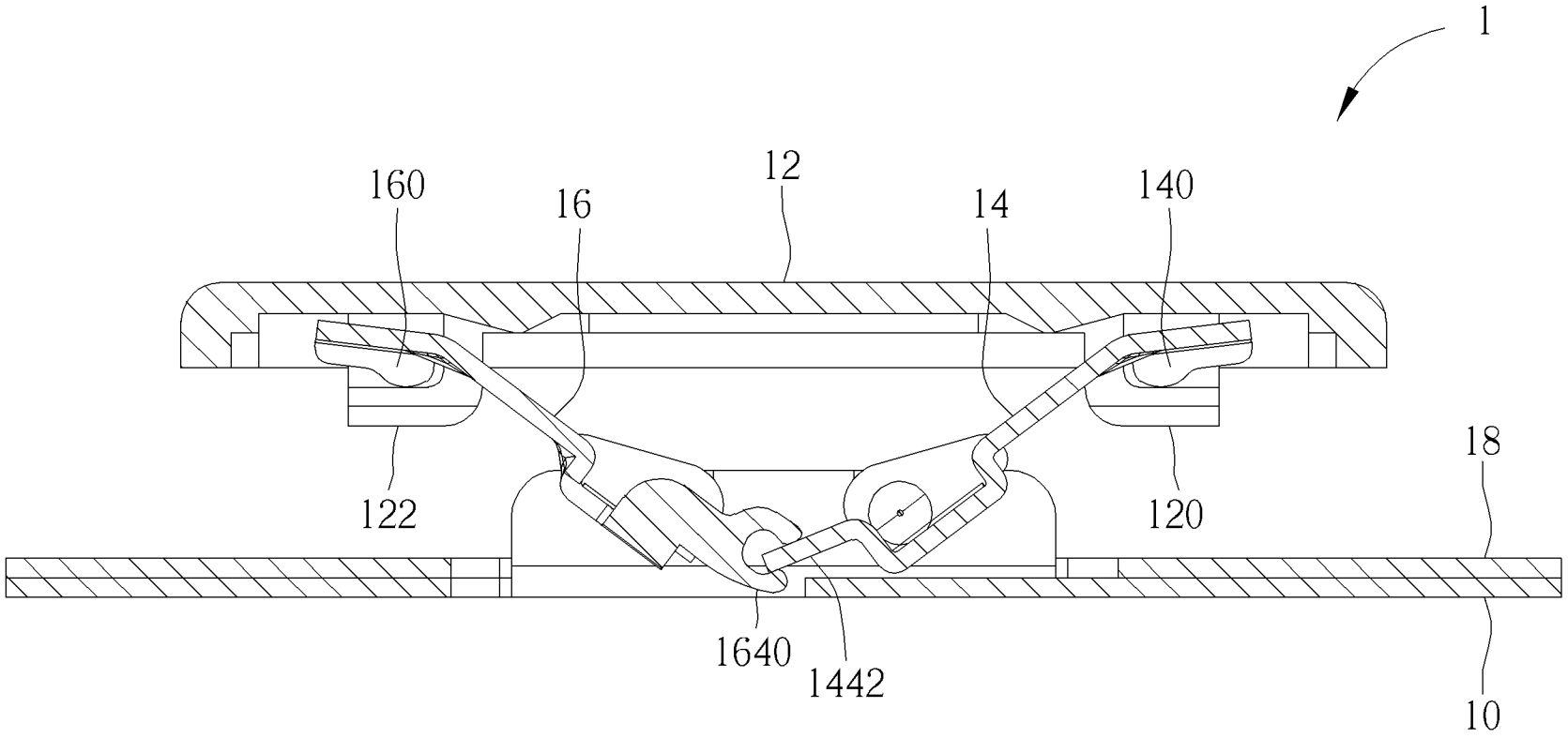
FIG. 6 is a sectional view illustrating the key switch along line X-X shown in FIG. 1.
Figure 7:
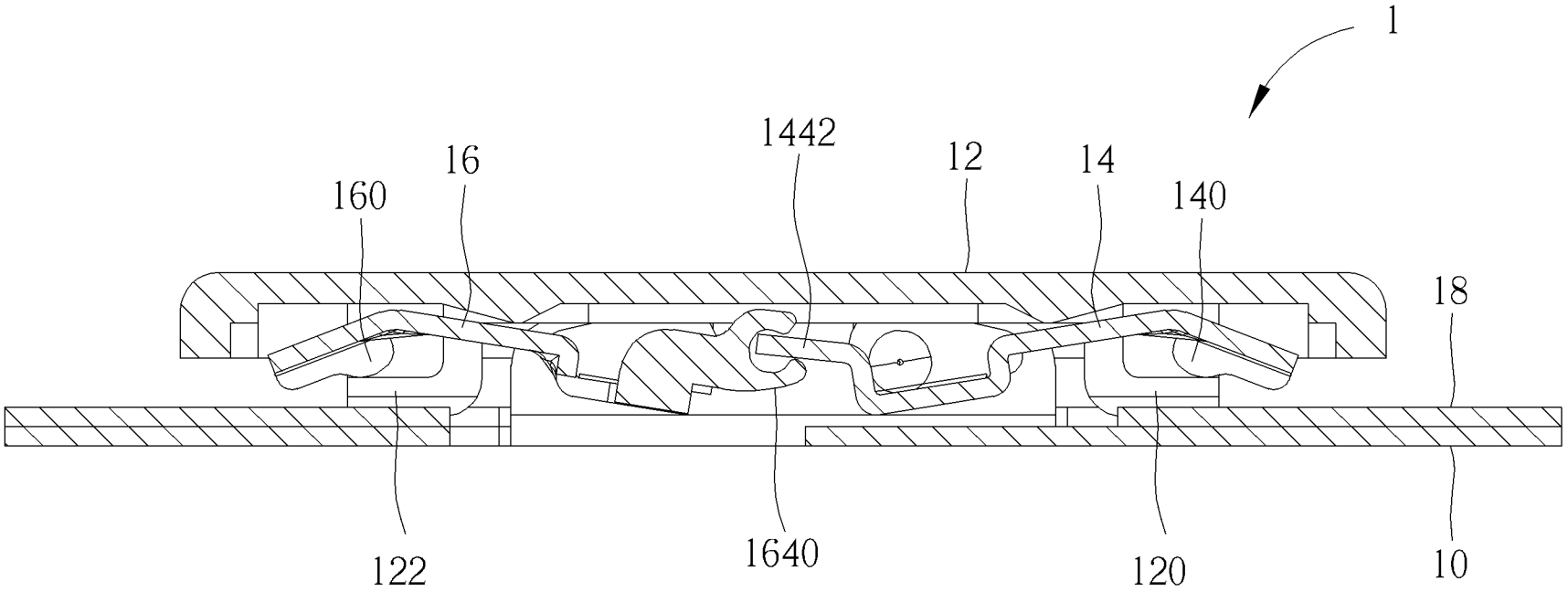
FIG. 7 is a sectional view illustrating the key cap shown in FIG. 6 being pressed.
Figure 8:
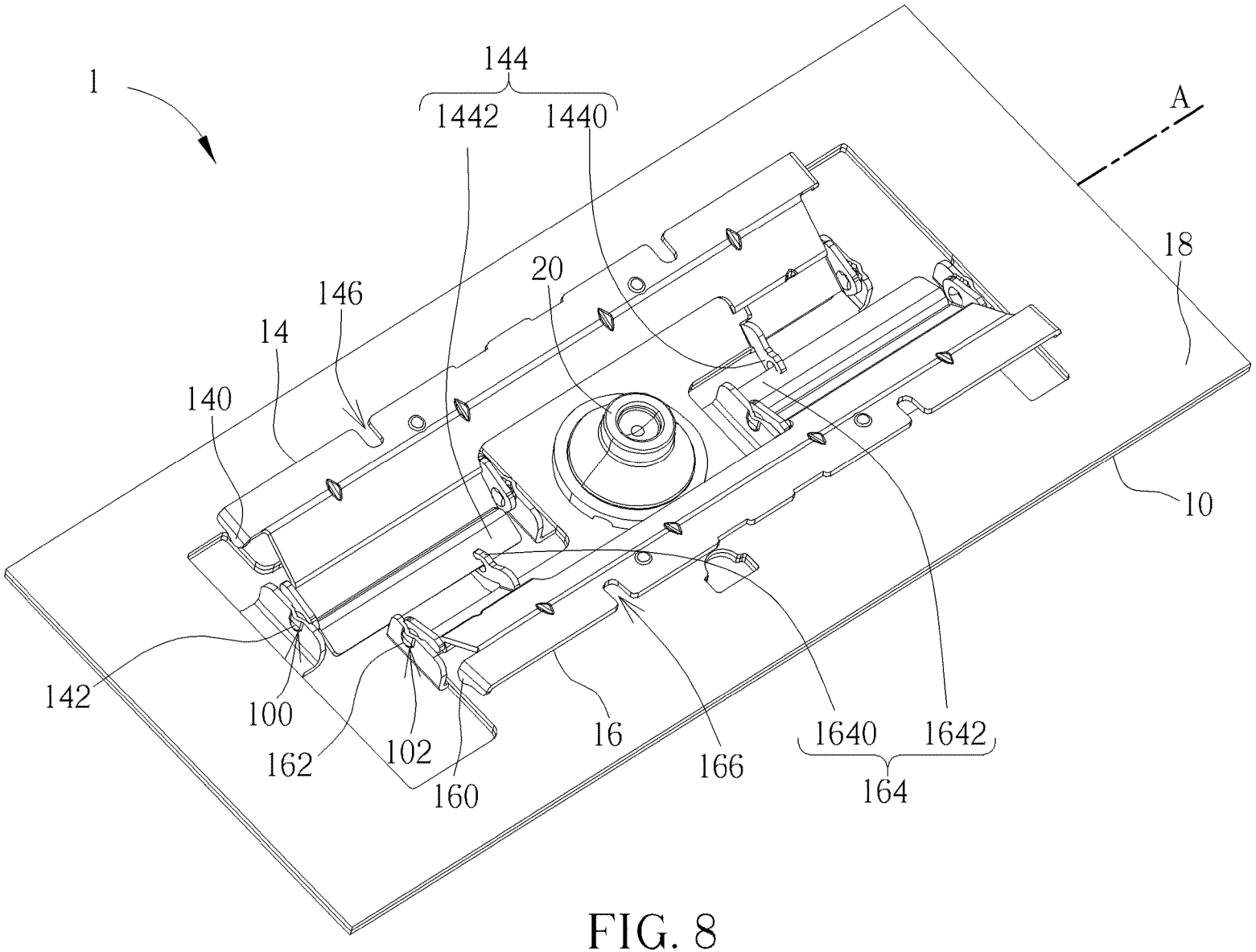
FIG. 8 is a perspective view illustrating the first support member and the second support member shown in FIG. 4 after horizontally moving with respect to each other.
Figure 9:
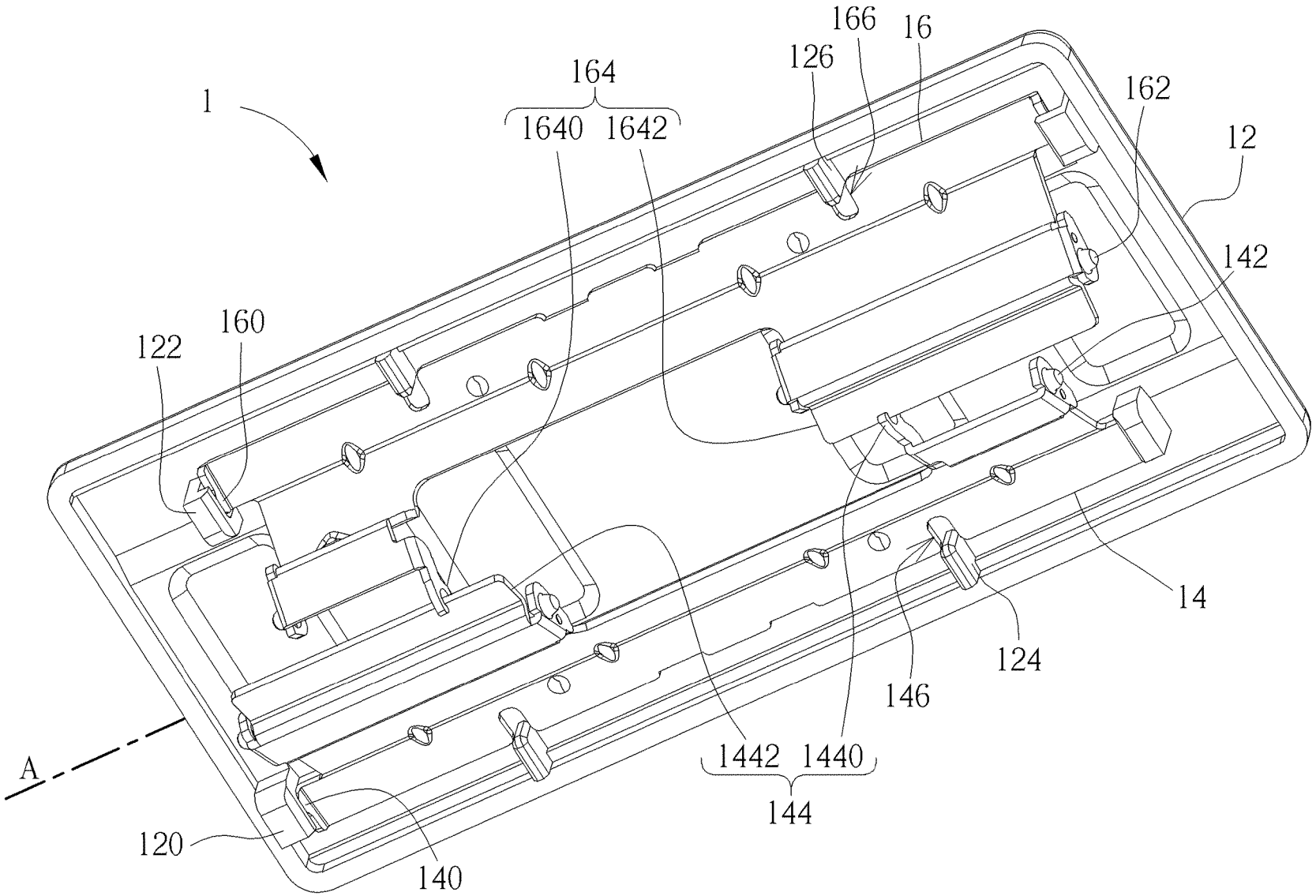
FIG. 9 is a perspective view illustrating the first support member and the second support member shown in FIG. 5 after horizontally moving with respect to each other.

Referring to FIGS. 1 to 9, FIG. 1 is a perspective view illustrating a key switch 1 according to an embodiment of the invention, FIG. 2 is an exploded view illustrating the key switch 1 shown in FIG. 1, FIG. 3 is an exploded view illustrating the key switch 1 shown in FIG. 1 from another viewing angle, FIG. 4 is an assembly view illustrating the base 10, the first support member 14, the second support member 16, the circuit board 18 and the resilient member 20 shown in FIG. 2, FIG. 5 is an assembly view illustrating the key cap 12, the first support member 14 and the second support member 16 shown in FIG. 3, FIG. 6 is a sectional view illustrating the key switch 1 along line X-X shown in FIG. 1, FIG. 7 is a sectional view illustrating the key cap 12 shown in FIG. 6 being pressed, FIG. 8 is a perspective view illustrating the first support member 14 and the second support member 16 shown in FIG. 4 after horizontally moving with respect to each other, and FIG. 9 is a perspective view illustrating the first support member 14 and the second support member 16 shown in FIG. 5 after horizontally moving with respect to each other.

As shown in FIGS. 1 to 7, the key switch 1 comprises a base 10, a key cap 12, a first support member 14, a second support member 16, a circuit board 18 and a resilient member 20. In practical applications, the circuit board 18 may be, but not limited to, a membrane circuit board and the resilient member 20 may be, but not limited to, a rubber dome.

The key cap 12 is disposed with respect to the base 10. The first support member 14 and the second support member 16 are disposed between the key cap 12 and the base 10, and the second support member 16 is disposed with respect to the first support member 14, such that the key cap 12 can move with the first support member 14 and the second support member 16 between a non-pressed position (as shown in FIG. 6) and a pressed position (as shown in FIG. 7). The circuit board 18 is disposed on the base 10 and the resilient member 20 is disposed on the circuit board 18. After the key cap 12 is pressed by a user, the resilient member 20 provides an elastic force for the key cap 12, such that the key cap can return to an original position before being pressed.

In this embodiment, the first support member 14 may have two first sliding portions 140 and two first pivot portions 142, the second support members 16 may have two second sliding portions 160 and two second pivot portions 162, the key cap 12 may have two first sliding grooves 120 corresponding to the two first sliding portions 140 and two sliding grooves 122 corresponding to the two second sliding portions 160, and the base 10 may have two first pivot holes 100 corresponding to the two first pivot portions 142 and two pivot holes 102 corresponding to the two second pivot portions 162. The first siding portion 140 is slidably disposed in the first sliding groove 120 of the key cap 12 and the first pivot portion 142 is rotatably connected to the first pivot hole 100 of the base 10, such that the first support member 14 can rotate between the positions shown in FIGS. 6 and 7. Similarly, the second siding portion 160 is slidably disposed in the second sliding groove 122 of the key cap 12 and the second pivot portion 162 is rotatably connected to the second pivot hole 102 of the base 10, such that the second support member 16 can rotate between the positions shown in FIGS. 6 and 7.

Furthermore, the first support member has a first linkage structure 144 and the second support member 16 has a second linkage structure 164. The first linkage structure 144 and the second linkage structure 164 abut against each other, such that the first support member 14 and the second support member 16 can rotate synchronously with respect to a horizontal axis A. In this embodiment, the first linkage structure 144 may comprise a first engaging portion 1440 and a first engaging plate 1442, and the second linkage structure 164 may comprise a second engaging portion 1640 and a second engaging plate 1642. To assemble the first support member 14 and the second support member 16, the first engaging plate 1442 engages with the second engaging portion 1640 and the second engaging plate 1642 engages with the first engaging portion 1440, such that the first linkage structure 144 and the second linkage structure 164 abut against each other. Accordingly, when the key cap 12 is pressed, the first support member 14 and the second support member 16 can drive each other to rotate. In this embodiment, the first engaging portion 1440 and the second engaging portion 1640 may be designed as C-shape, such that the first engaging portion 1440 and the second engaging plate 1642 forma gear-like engaging structure and the second engaging portion 1640 and the first engaging plate 1442 also form a gear-like engaging structure. Accordingly, the first support member 14 and the second support member 16 can drive each other to rotate more stably and more smoothly.

As shown in FIGS. 3 and 5, the first support member 14 may have two first restraining recesses 146, the second support member 16 may have two second restraining recesses 166, and the key cap 12 may have two first restraining portions 124 corresponding to the two first restraining recesses 146 and two second restraining portions 126 corresponding to the two second restraining recesses 166. The first restraining portion 124 is slidably inserted to the first restraining recess 146, such that the first restraining portion 124 slides in the first restraining recess 146 when the first support member 14 horizontally slides with respect to the key cap 12. Similarly, the second restraining portion 126 is slidably inserted to the second restraining recess 166, such that the second restraining portion 126 slides in the second restraining recess 166 when the second support member 16 horizontally slides with respect to the key cap 12.

In this embodiment, lengths of the first engaging plate 1442 and the second engaging plate 1642 along the horizontal axis A are larger than lengths of the second engaging portion 1640 and the first engaging portion 1440 along the horizontal axis A, respectively. Accordingly, when one of the first support member 14 and the second support member 16 horizontally moves with respect to the other one of the first support member 14 and the second support member 16 within a predetermined range R along the horizontal axis A, the first linkage structure 144 and the second linkage structure 164 always keep abutting against each other, wherein the aforesaid predetermined range R is a length range of the first engaging plate 1442 and the second engaging plate 1642 along the horizontal axis A. Accordingly, the first support member 14 and the second support member 16 can horizontally move with respect to each other within the predetermined range R along the horizontal axis A, so as to be applied to different key switches with different sizes. Therefore, when a keyboard is manufactured, the invention may classify the key switches with different sizes first and then design the first support member 14 and the second support member 16 for each type of key switch. Accordingly, the invention can simplify the mold type and reduce the number of molds, so as to reduce the manufacturing cost. Moreover, the first support member 14 and the second support member 16 may have identical structure, such that the first support member 14 and the second support member 16 may be manufactured by identical mold, so as to further reduce the manufacturing cost.

As shown in FIGS. 8 and 9, after the first support member 14 and the second support member 16 horizontally move with respect to each other along the horizontal axis A, the first support member 14 and the second support member 16 can be applied to a key switch with different size. At this time, the positions of the first pivot hole 100 and the second pivot hole 102 of the base 10 need to be adjusted according to the movements of the first support member 14 and the second support member 16, as shown in FIG. 8. Furthermore, the positions of the first sliding groove 120, the second sliding groove 122, the first restraining portion 124 and the second restraining portion 126 also need to be adjusted according to the movements of the first support member 14 and the second support member 16, as shown in FIG. 9.

Figure 10:
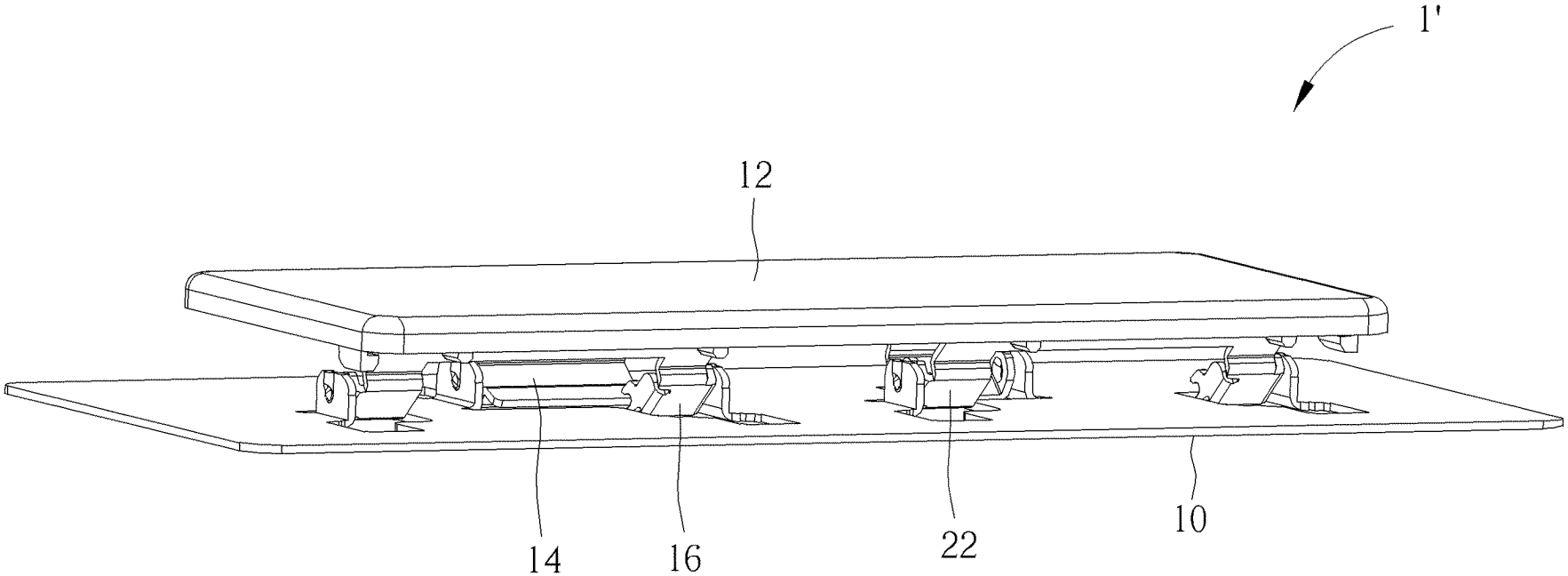
FIG. 10 is a perspective view illustrating a key switch according to another embodiment of the invention.
Figure 11:
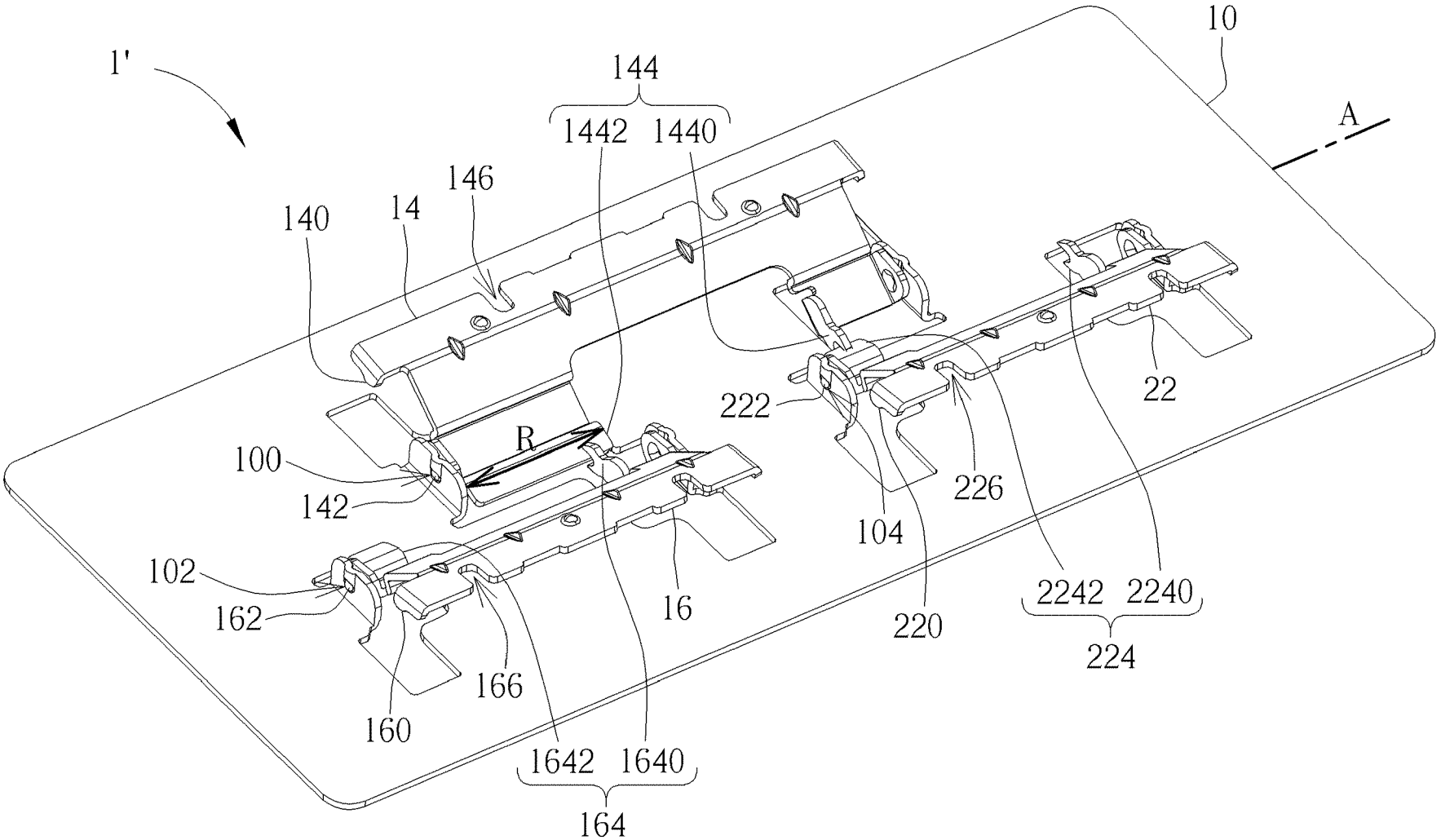
FIG. 11 is a perspective view illustrating the key switch shown in FIG. 10 after removing the key cap.
Figure 12:
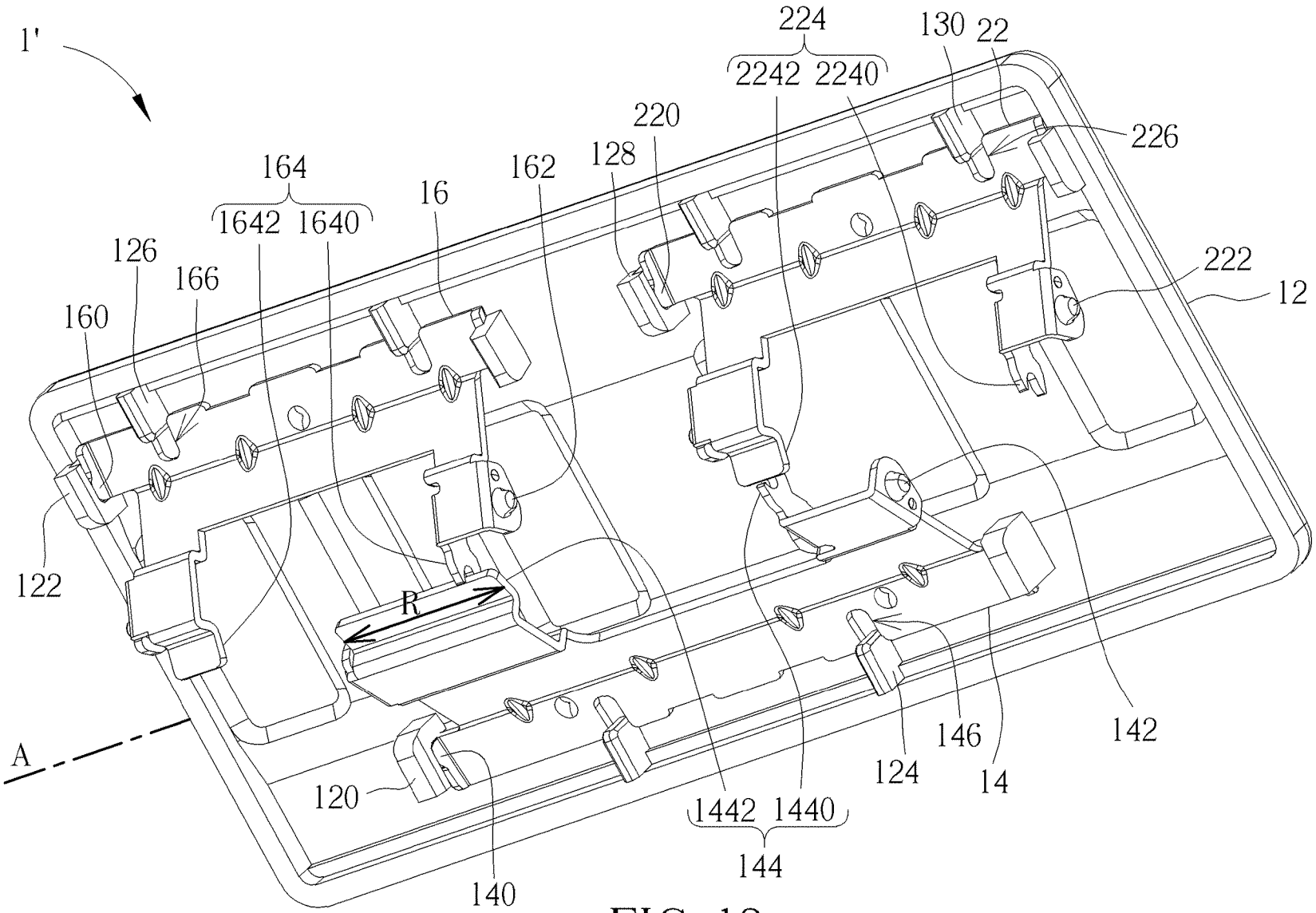
FIG. 12 is a perspective view illustrating the key switch shown in FIG. 10 after removing the base.
Figure 13:
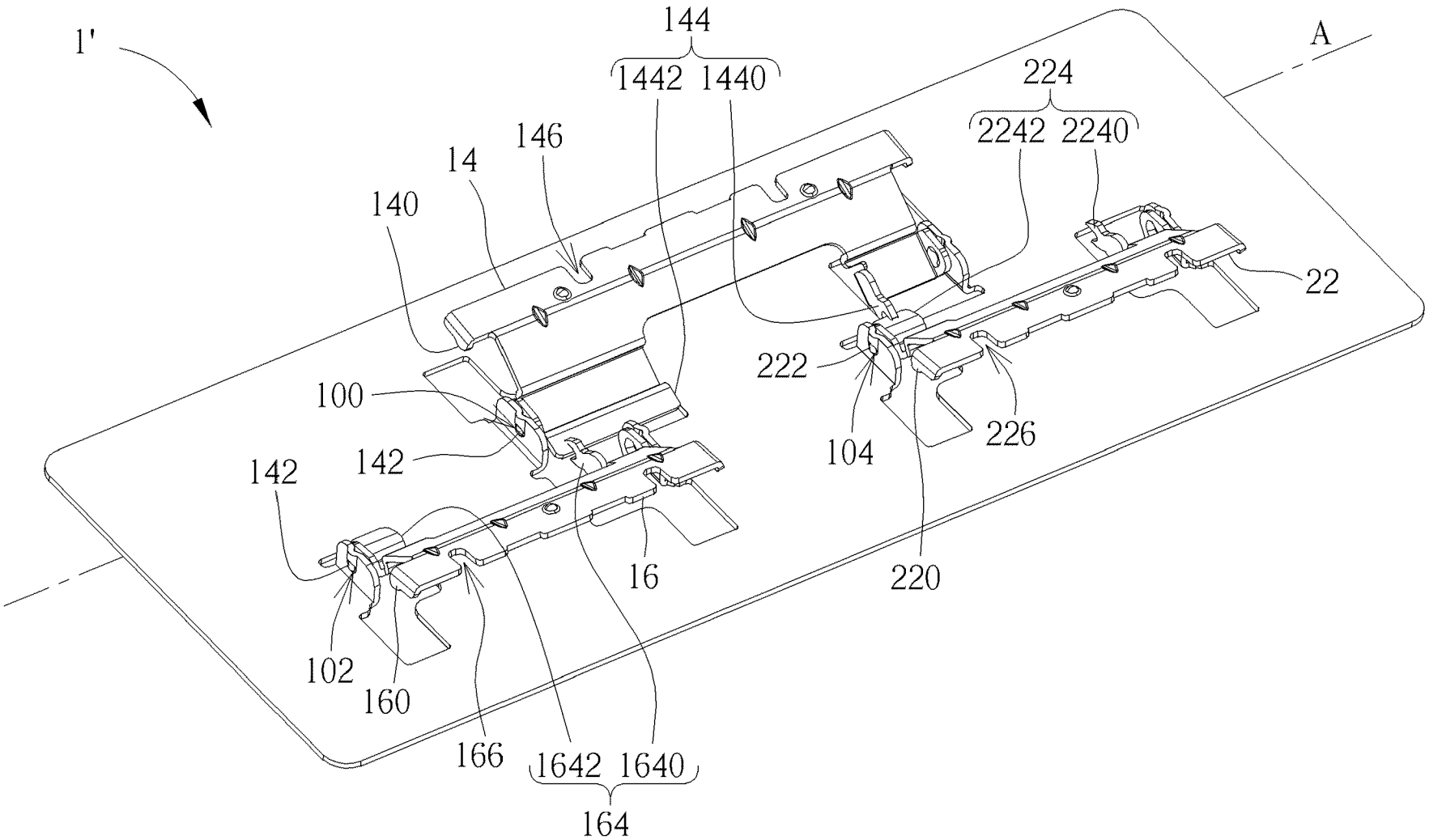
FIG. 13 is a perspective view illustrating the first support member and the second support member shown in FIG. 11 after horizontally moving with respect to each other.
Figure 14:
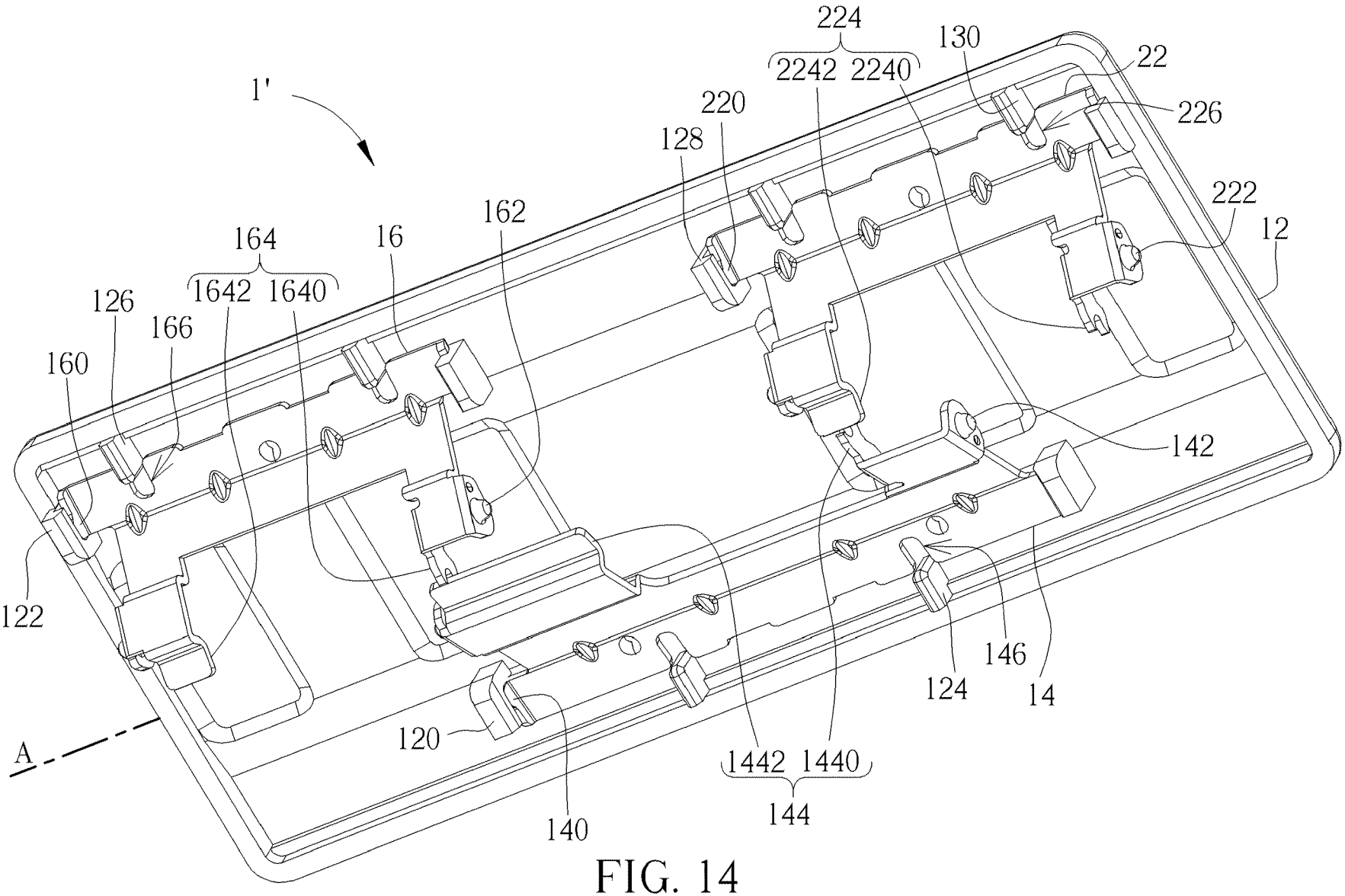
FIG. 14 is a perspective view illustrating the first support member and the second support member shown in FIG. 12 after horizontally moving with respect to each other.

Referring to FIGS. 10 to 14, FIG. 10 is a perspective view illustrating a key switch 1' according to another embodiment of the invention, FIG. 11 is a perspective view illustrating the key switch 1' shown in FIG. 10 after removing the key cap 12, FIG. 12 is a perspective view illustrating the key switch 1' shown in FIG. 10 after removing the base 10, FIG. 13 is a perspective view illustrating the first support member 14 and the second support member 16 shown in FIG. 11 after horizontally moving with respect to each other, and FIG. 14 is a perspective view illustrating the first support member 14 and the second support member 16 shown in FIG. 12 after horizontally moving with respect to each other. It should be noted that the same elements in FIGS. 10-14 and FIGS. 1-9 are represented by the same numerals, so the repeated explanation will not be depicted herein again.

The main difference between the key switch 1' and the aforesaid key switch 1 is that the key switch 1' further comprises a third support member 22. As shown in FIGS. 10 to 12, the third support member 22 is disposed between the key cap 12 and the base 10 and with respect to the first support member 14. In this embodiment, the second support member 16 and the third support member 22 may be arranged side by side and located at opposite sides of the first support member 14. Furthermore, the second support member 16 and the third support member 22 may have identical structure, such that the second support member 16 and the third support member 22 may be manufactured by identical mold, so as to further reduce the manufacturing cost.

In this embodiment, the third support member 22 may have two third sliding portions 220 and two third pivot portions 222, the key cap 12 may have two third sliding grooves 128 corresponding to the two third sliding portions 220, and the base 10 may have two third pivot holes 104 corresponding to the two third pivot portions 222. The third siding portion 220 is slidably disposed in the third sliding groove 128 of the key cap 12 and the third pivot portion 222 is rotatably connected to the third pivot hole 104 of the base 10, such that the third support member 22 can rotate with respect to the key cap 12 and the base 10.

Still further, the third support member 22 has a third linkage structure 224. In this embodiment, the first linkage structure 144 of the first support member 14 abuts against the second linkage structure 164 of the second support member 16 and the third linkage structure 224 of the third support member 22, such that the first support member 14, the second support member 16 and the third support member 22 can rotate synchronously with respect to the horizontal axis A. In this embodiment, the third linkage structure 224 may comprise a second engaging portion 2240 and a second engaging plate 2242. To assemble the first support member 14 and the third support member 22, the second engaging plate 2242 engages with the first engaging portion 1440, such that the first linkage structure 144 and the third linkage structure 224 abut against each other. Accordingly, when the key cap 12 is pressed, the first support member 14, the second support member 16 and the third support member 22 can drive each other to rotate. In this embodiment, the first engaging portion 1440 and the second engaging portion 1640 may be designed as C-shape, such that the first engaging portion 1440 and the second engaging plate 2242 form a gear-like engaging structure and the second engaging portion 1640 and the first engaging plate 1442 also form a gear-like engaging structure. Accordingly, the first support member 14, the second support member 16 and the third support member 22 can drive each other to rotate more stably and more smoothly.

As shown in FIG. 12, the third support member 22 may have two third restraining recesses 226 and the key cap 12 may have two third restraining portions 130 corresponding to the two third restraining recesses 226. The third restraining portion 130 is slidably inserted to the third restraining recess 226, such that the third restraining portion 130 slides in the third restraining recess 226 when the third support member 22 horizontally slides with respect to the key cap 12.

In this embodiment, the length of the first engaging plate 1442 along the horizontal axis A is larger than the length of the second engaging portion 1640 along the horizontal axis A. Accordingly, when one of the first support member 14 and the second support member 16 horizontally moves with respect to the other one of the first support member 14 and the second support member 16 within a predetermined range R along the horizontal axis A, the first linkage structure 144 and the second linkage structure 164 always keep abutting against each other, wherein the aforesaid predetermined range R is a length range of the first engaging plate 1442 along the horizontal axis A. Accordingly, the first support member 14 and the second support member 16 can horizontally move with respect to each other within the predetermined range R along the horizontal axis A, so as to be applied to different key switches with different sizes. Furthermore, the invention may add the third support member 22 for a key switch with larger size. Therefore, when a keyboard is manufactured, the invention may classify the key switches with different sizes first and then design the first support member 14, the second support member 16 and the third support member 22 for each type of key switch. Accordingly, the invention can simplify the mold type and reduce the number of molds, so as to reduce the manufacturing cost.

As shown in FIGS. 13 and 14, after the second support member 16 horizontally move with respect to the first support member 14 along the horizontal axis A, the first support member 14, the second support member 16 and the third support member 22 can be applied to a key switch with different size. At this time, the position of the second pivot hole 102 of the base 10 needs to be adjusted according to the movement of the second support member 16, as shown in FIG. 13. Furthermore, the positions of the second sliding groove 122 and the second restraining portion 126 also need to be adjusted according to the movement of the second support member 16, as shown in FIG. 14.

As mentioned in the above, two support members of the invention can horizontally move with respect to each other within the predetermined range along the horizontal axis, so as to be applied to different key switches with different sizes. Therefore, when a keyboard is manufactured, the invention may classify the key switches with different sizes first and then design the support member for each type of key switch. Accordingly, the invention can simplify the mold type and reduce the number of molds, so as to reduce the manufacturing cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A key switch comprising:

a base;

a key cap disposed with respect to the base;

a first support member disposed between the key cap and the base, the first support member having a first linkage structure, the first linkage structure comprising a first engaging portion and a first engaging plate;

a second support member disposed between the key cap and the base and with respect to the first support member, the second support member having a second linkage structure, the second linkage structure comprising a second engaging portion; and a third support member disposed between the key cap and the base and with respect to the first support member, the third support member having a third linkage structure, the third linkage structure comprising a second engaging plate;

wherein the first engaging plate engages with the second engaging portion, such that the first linkage structure and the second linkage structure abut against each other, and the first support member and the second support member rotate synchronously with respect to a horizontal axis; the second engaging plate engages with the first engaging portion, such that the first linkage structure and the third linkage structure abut against each other, and the first support member and the third support member rotate synchronously with respect to the horizontal axis; when one of the first support member and the second support member horizontally moves with respect to the other one of the first support member and the second support member within a predetermined range along the horizontal axis, the first linkage structure and the second linkage structure keep abutting against each other; the predetermined range is a length range of the first engaging plate along the horizontal axis, and wherein a length of the first engaging plate along the horizontal axis is larger than a length of the second engaging portion along the horizontal axis.

* * * * *